US005967244A

United States Patent [19]

Arfele

[11] Patent Number: 5,967,244

[45] Date of Patent: Oct. 19, 1999

[54] DRILL BIT DIRECTIONAL NOZZLE

[75] Inventor: Robert W. Arfele, Houston, Tex.

[73] Assignee: Dresser Industries, Inc., Dallas, Tex.

[21] Appl. No.: 08/879,401

[22] Filed: Jun. 20, 1997

[51] Int. Cl.[6] ..... E21B 10/60

[52] U.S. Cl. ..... 175/340; 175/424

[58] Field of Search ..... 175/339, 340, 175/393, 424; 239/600

[56] References Cited

U.S. PATENT DOCUMENTS

| | | | |
|---|---|---|---|
| 4,381,825 | 5/1983 | Radtke | 175/393 |
| 4,533,005 | 8/1985 | Morris . | |
| 4,542,798 | 9/1985 | Madigan . | |
| 4,603,750 | 8/1986 | Sorenson . | |
| 4,658,918 | 4/1987 | Matson . | |
| 4,687,067 | 8/1987 | Smith et al. | 175/424 X |
| 4,703,814 | 11/1987 | Nguyen | 175/424 X |
| 4,711,311 | 12/1987 | Underwood et al. | 175/340 |
| 4,739,845 | 4/1988 | Dennis | 175/340 X |
| 4,776,412 | 10/1988 | Thompson . | |
| 4,794,995 | 1/1989 | Matson et al. . | |
| 4,878,548 | 11/1989 | Ostertag et al. . | |
| 5,494,122 | 2/1996 | Larsen et al. | 175/393 X |

*Primary Examiner*—David J. Bagnell
*Assistant Examiner*—Sunil Singh
*Attorney, Agent, or Firm*—Browning Bushman

[57] ABSTRACT

A nozzle assembly with a directional flow passage for directing and controlling the flow of drilling fluids exiting a drill bit. The assembly is threaded for engagement within a threaded receptacle in the drill bit. The assembly includes a nozzle body carried within an externally threaded sleeve structure that threads into the bit receptacle. Seating of the assembly anchors the nozzle body against rotational and axial movement. The external circumferential nozzle body surface and the internal circumferential sleeve surface mechanically interlock to permit the nozzle body to be positioned at selected different angular positions within the sleeve before seating the sleeve structure in the receptacle such that the final seated position of the assembly in the receptacle results in the desired orientation of the nozzle flow passage in the bit receptacle. The flow passage exit end of the nozzle is surrounded by a drive area that extends axially from the main nozzle body. A conventional socket drive tool engaging the drive area is employed to rotate the nozzle and surrounding threaded sleeve structure into or out of engagement with the threaded receptacle.

22 Claims, 1 Drawing Sheet

FIG. 1
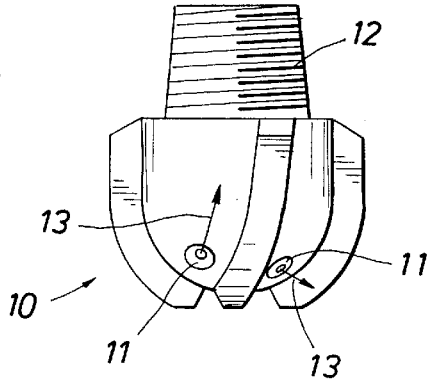
FIG. 2
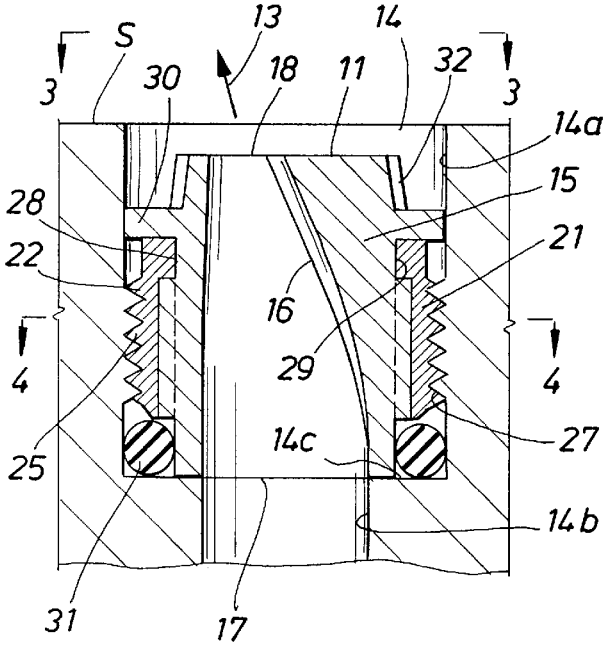
FIG. 4
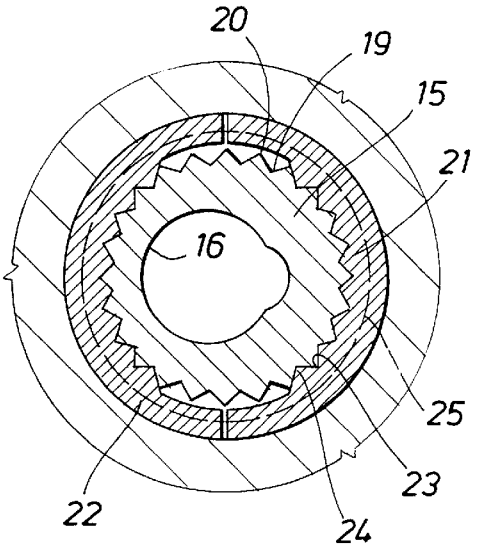
FIG. 5
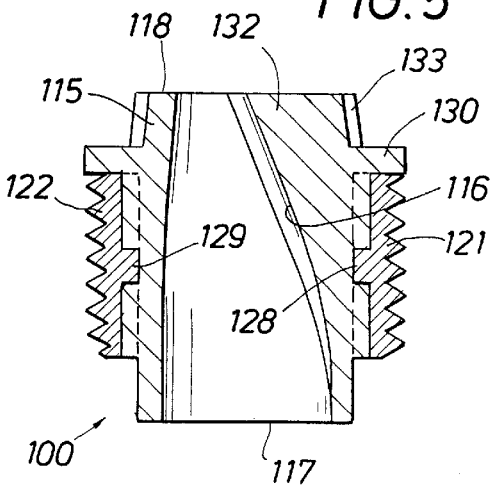
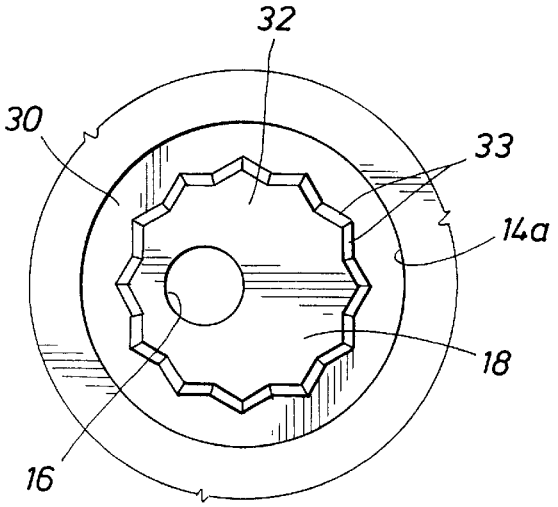
FIG. 3

DRILL BIT DIRECTIONAL NOZZLE

BACKGROUND OF THE INVENTION

1. Field of the Invention

The present invention relates generally to drilling well bores through the earth with a rotary drill bit. More specifically, the present invention relates to the structure and use of a nozzle employed to direct and control the flow of drilling fluids exiting from a drill bit.

2. Brief Description of the Prior Art Background of the Invention

Wells drilled in the earth are commonly formed with the use of a rotating drill bit positioned at the bottom of a tubular drill string. Rotation of the bit progressively cuts away the earthen formations engaged by the bit face to form a well bore. Drilling fluids pumped down the drill string to the bit exit the bit face through nozzles strategically disposed in the bit body. The fluid is used to clean, cool and lubricate the bit and assist in breaking away the formation. The fluid also serves to maintain pressure equilibrium within the well bore and carry formation cuttings back to the well surface.

Proper operation of the bit requires that the drilling fluid exit the bit with a flow pattern and velocity that are suited for a given bit design, as well as the anticipated well drilling environment. Nozzles carried in the drill bit function to direct and control the flow path and the pattern and velocity of the drilling fluids exiting the bit.

Drill bit bodies are customarily provided with internally threaded nozzle receptacles that can receive externally threaded nozzle bodies having a desired jetting characteristic. With conventional, non-directional nozzle bodies, the final angular orientation of the nozzle body once seated in the bit receptacle does not affect the proper operation of the fluid jetting action of the nozzle. However, where the fluid is to leave the nozzle at an angle relative to the nozzle axis, the final angular disposition of the nozzle within the receptacle determines the direction of flow of the exiting fluid over the bit body.

A nozzle having a directional exit flow pattern must remain firmly anchored within the nozzle receptacle after its installation so that it does not move axially or angularly during use. One technique for preventing such movement is to cement the nozzle within the receptacle at the desired axial and angular position. This technique suffers various shortcomings including the possible failure of the cement to properly retain the nozzle in place as well as the difficulty encountered in removing and replacing the nozzle after it has been cemented within the receptacle.

Proper final orientation of the nozzle in a threaded receptacle can be achieved by exactly matching the external threaded surface of the nozzle to that of the thread pattern in the receptacle such that the nozzle is seated and can no longer be rotated at the precise orientation producing the desired exit flow direction. One of the problems encountered in attempting to time the nozzle thread pattern to that of the receptacle threads relates to the need to form a precisely developed thread on the external surface of the nozzle body. The nozzle is desirably constructed from an extremely hard material such as tungsten carbide that is very difficult to machine. For this reason, nozzle assemblies are frequently constructed as multi-part components that include a tungsten carbide body and a surrounding steel sleeve with the threads machined into the softer steel material of the sleeve.

In some of the prior art designs, the sleeve is brazed or otherwise bonded to the nozzle body to prevent relative rotation between the two components. This technique can permit the nozzle and receptacle thread patterns to be timed with the nozzle flow direction so that the final seated position of the nozzle produces the desired orientation of the exit flow path from the bit. Use of this technique requires that each nozzle and sleeve assembly be bonded to be used in a specific matching receptacle. The technique is also limiting in that it is necessary to perform a bonding step immediately before the nozzle is installed, making field installations complicated and difficult. The use of shims to control the final seated position of the nozzle is also impressive and difficult to implement.

Some prior art nozzle bodies are formed by molding tungsten carbide to provide a single material body with an externally threaded surface. Creation of a precisely molded thread pattern that will meet with the internal threads of a specific nozzle receptacle such the final, seated position of the nozzle in the receptacle results in a predetermined orientation of the directional nozzle is also difficult to achieve. In general, techniques that require matching nozzle and receptacle threads in single body or bonded nozzle construction to determine final, seated orientation of a directional nozzle relative to the bit body are difficult and time-consuming.

The prior art includes a multiple-piece nozzle design in which an externally threaded, split sleeve closely surrounds a cylindrical nozzle body. The nozzle body may be angularly positioned within the sleeve before the assembly is placed in the receptacle so that the nozzle body is properly oriented when the nozzle and sleeve assembly is seated. This prior art design, described in U.S. Pat. No. 4,533,005 to Morrison, employs frictional force between the engaged, smooth internal cylindrical surfaces of the sleeve and nozzle body to hold the nozzle orientation once the nozzle has been seated in the receptacle. A specially configured tool is required to seat and extract the nozzle. The tool includes axially extending fingers that simultaneously engage aligned openings in the nozzle body and the threaded sleeve so that the two components of the nozzle assembly may be rotated as a unit. The fixed angular position of the nozzle is determined by rotating the nozzle within the sleeve to a selected angular position that will result in the desired final nozzle orientation when the sleeve is firmly seated within the nozzle receptacle.

While the Morrison prior art design offers improvements over the technique of cementing the nozzle within the receptacle, or attempting to match nozzle and receptacle thread patterns, the anchored nozzle of the Morrison design is susceptible to rotation during use because of the reliance on frictional engagement alone to prevent such rotation. Retaining the proper orientation of the nozzle body within the sleeve before the assembly is finally seated can also be difficult because of the slippage that may occur before the assembly is fully seated.

U.S. Pat. No. 4,794,995 to Matson describes a directional nozzle assembly that is held in place by an externally threaded sleeve. As with the Morrison design, the Matson design relies on frictional engagement between the sleeve and the nozzle body to prevent rotation of the nozzle within the sleeve.

A prior art nozzle design that employs a mechanical interlock rather than frictional engagement to prevent nozzle rotation is described in U.S. Pat. No. 4,776,412 to Thompson. The design employs a specially shaped bit receptacle having circumferentially spaced slots that mate with corresponding spaced nibs formed at the base of the nozzle body. A specially configured drive tool is employed to seat an externally threaded sleeve into the threaded receptacle and over the cylindrical nozzle body to hold the nozzle in the receptacle. Rotation of the nozzle is prevented by the interlocking engagement of the bit recess slots and the nozzle nibs. While the design is effective in preventing rotation of the installed nozzle, it is complex, requires a relatively large number of separate construction components, is difficult to build, and requires the use of a special drive tool.

SUMMARY OF THE INVENTION

The nozzle assembly of the present invention comprises an externally threaded sleeve structure that houses and retains a nozzle body at multiple, selectable, angular positions within the sleeve. A series of axially extending, circumferentially spaced planar surfaces formed on the external surface of the nozzle body engage interfering forms on the internal surface of the sleeve to prevent relative angular displacement between the nozzle and sleeve. In a preferred form, the interfering surfaces are axially extending grooves and ridges on the mating sleeve and nozzle surfaces. When seated in a nozzle receptacle, the mechanical locking engagement between the grooves and ridges of the nozzle and sleeve surfaces prevents relative angular displacement between the two. An axially extending drive area surrounding the nozzle flow passage exit is engageable by a conventional socket drive tool to rotate the combined nozzle and sleeve assembly into and out of seating engagement within the bit receptacle.

The formation of a relatively large number of ridges and grooves in the mating surfaces between the sleeve and nozzle permit the two components of the nozzle assembly to be angularly displaced at relatively small angular increments to ensure close control over the final seated position of the nozzle in the bit receptacle.

The provision of a drive surface area at the nozzle exit end permits the use of a conventional socket drive tool to seat and retract the nozzle assembly. The mechanical interlock between the nozzle and the surrounding sleeve enables the use of the conventional drive to rotate the nozzle and sleeve assembly simultaneously.

From the foregoing it will be appreciated that a primary object of the present invention is to provide a directional nozzle assembly that may be accurately seated in a drill bit at a desired angular position.

Another object of the present invention is to provide a nozzle assembly that may be adjusted to different angular positions in which the nozzle is retained in mechanically locked engagement with the nozzle receptacle.

Yet another object of the present invention is to provide a directional nozzle assembly that may be seated and withdrawn from a bit receptacle using a conventional drive tool.

It is also an object of the present invention to provide a nozzle assembly in which the nozzle may be indexed to a precise angular position seated in a nozzle receptacle using a small number of components that are simple and inexpensive to fabricate and employ.

An object of the present invention is to provide an indexable nozzle assembly that firmly anchors the nozzle against axial and angular movement when the assembly is seated in a nozzle receptacle.

An object of the present invention is to provide a single nozzle assembly design that may be used in a bit to provide selected, different exit flow paths for multiple nozzle installations on the bit without need for mechanically cementing, brazing, or otherwise permanently bonding their installation.

The foregoing objects, features and advantages of the present invention, as well as others, will be more fully understood and appreciated by reference to the following drawings, specification and claims.

BRIEF DESCRIPTION OF THE DRAWINGS

FIG. 1 is an elevation of a drill bit secured to the bottom of a drill string and equipped with a directional nozzle assembly of the present invention;

FIG. 2 is a vertical cross-section illustrating a nozzle assembly of the present invention seated within a threaded nozzle receptacle in a drill bit body;

FIG. 3 is a view taken along the line 3—3 of FIG. 2 illustrating the exit end of the nozzle assembly and bit arrangement of the present invention;

FIG. 4 is a view taken along the line 4—4 of FIG. 2 illustrating details in the construction and operation of the nozzle assembly of the present invention; and FIG. 5 is a vertical cross-sectional view illustrating a modified form of the nozzle assembly of the present invention.

DESCRIPTION OF THE PREFERRED EMBODIMENTS

A drill bit indicated generally at 10 in FIG. 1 is illustrated equipped with directional nozzle assemblies 11 of the present invention. The nozzle assemblies 11 are threadedly engaged within receiving receptacles in the drill bit body. The drill bit assembly 10 is connected by a threaded pin 12 to the bottom of a drill string (not illustrated) through which drilling fluids are supplied to the bit and exit the bit as indicated by the arrows 13. The nozzle assemblies 11 are designed to assist in controlling the direction of flow of the fluid exiting the drill bit, as well as to assist in controlling the pattern of fluid flow and the flow velocity.

With reference to FIG. 2, a preferred form of the nozzle assembly 11 of the present invention is illustrated threadedly received within a bit receptacle 14 that extends from the bit surface S through bit flow passage sections 14*a* and 14*b* to the drill string 12. The nozzle assembly 11 includes an axially extending a main nozzle body 15 with an axially extending central nozzle flow passage 16. The nozzle body is constructed of tungsten carbide or other suitable hard, erosion-resistant material. The nozzle flow passage 16 has an entrance end 17 that seats against a restriction 14*c* formed between the bit flow passage sections 14*a* and 14*b*. The opening through the nozzle flow passage 16 has substantially the same cross-sectional dimensions as the bit flow passage 14*b*. The nozzle body 15 is provided with an exit end 18 at which the nozzle passage terminates. The passage 16 constricts and extends radially away from the central nozzle axis toward one side of the nozzle to produce a jet flow stream that exits the nozzle in the direction of the arrow 13. The interior surface of the flow passage 16 is configured as desired to produce a specific directional flow and flow rate through the nozzle.

As illustrated by joint reference to FIGS. 2 and 4, the external surface of the main body 15 is of a substantially axially extending cylindrical form with axially extending grooves 19 and ridges 20 formed along the central section of the external nozzle body surface. The central portion of the nozzle body 15 is surrounded by a composite axially extending sleeve structure formed of sleeve halves 21 and 22. The sleeve structure is constructed of steel or other suitable, easily machinable material. With the sleeve structure installed over the nozzle body, axially extending grooves 23 and ridges 24 formed in the internal surface of the sleeve sections 21 and 22 mate with the ridges 20 and grooves 19 of the nozzle body 15. This engagement of the respective grooves and ridges between the nozzle body and the surrounding sleeve provide a mechanical interlock or interference that prevents the nozzle body 15 from moving angularly relative to the sleeve structure when the assembly is installed in the drill bit 10. While a groove and ridge interlocking configuration between the nozzle and sleeve components has been expressly described, it will be understood that any suitable surface configuration may be employed on the external nozzle surface and on the internal sleeve surface that prevents relative angular movement between the two components when the surfaces are engaged. In general, such surfaces will include a radially inwardly protruding internal surface contour on the sleeve that is received within a radially inwardly depressed external surface on the nozzle to produce an interfering or interlocking surface contact area that limits relative angular movement between the nozzle and the sleeve.

The external surface of the sleeve segments 21 and 22 are provided with helical threads 25 that are designed to mate with internal threads 27 formed on the inner surface of the receptacle 14. The tops of the sleeve sections 21 and 22 are provided with radially inwardly extending lip sections 28 that engage a conforming annular groove 29 formed at the upper end of the nozzle body 15 to prevent relative axial movement between the sleeve structure and the nozzle body when the nozzle assembly is installed in the bit 10.

The upper end of the tungsten carbide nozzle body 15 is equipped with an annular ring section 30 that closely conforms to the internal surface of the receptacle 14. The ring section 30 assists in sheltering the underlying components of the nozzle assembly from particulate matter in the drilling fluids, as well as protecting the softer steel of the sleeve structure from the erosive effects of the drilling fluids emerging from the nozzle end 18. The base of the nozzle body 15 is surrounded by an elastomeric 0-ring seal 31 that forms a fluid seal between the external surface of the nozzle body and the internal surface of the receptacle 14. The seal 31 functions to prevent fluid from entering into the annular area between the nozzle body and the surrounding receptacle 14 to protect the threads and external nozzle structure from erosion caused by the flow of drilling fluids.

With joint reference to FIGS. 2 and 3, the exit end 18 of the nozzle body 15 is seen to include an axially extending drive area that is designed to receive a socket tool employed to rotate the nozzle into and out of the threaded receptacle 14. The drive area 32 is adapted to be engaged by a conventional socket wrench (not illustrated) that extends over the drive area and imparts rotary torque forces from the wrench to the engaged nozzle body. The drive area 32 comprises wrench flats 33 disposed circumferentially and concentrically with the central nozzle axis in surrounding relationship with the nozzle flow passage 16. The disposition and configuration of the illustrated drive area 32 ensures that the forces applied by a socket drive wrench are compressive, concentrically directed, and uniformly distributed about the structure of the drive area. The design of the drive area 32 assists in preventing breakage or damage to the relatively brittle, easily fractured tungsten carbide material of the nozzle.

In use, a trial seating of the assembly 10 is performed to establish the required nozzle and sleeve settings. The sleeve sections 21 and 22 are positioned about the nozzle body 15, a socket drive wrench is engaged with the drive area 32 and the nozzle assembly 11 is rotated into seated engagement against the restricted area 14*c* of the receptacle 14. The orientation of the nozzle passage exit is noted at the point of nozzle seating. The nozzle assembly is extracted from the receptacle, the sleeve structure sections 21 and 22 are disengaged from the nozzle body and the nozzle body is rotated relative to the sleeve structure as required to produce the desired final orientation of the nozzle when the assembly 11 is seated in the receptacle. By way of example, if the final orientation of the nozzle exit passage is 30 degrees from the desired orientation during the initial trial seating of the assembly, the nozzle body is rotated 30 degrees in the compensating direction relative to the sleeve structure and the assembly is then rethreaded into the receptacle. With the described adjustment between the angular positions of the nozzle body and the sleeve structure, the final position of the seated nozzle will result in the desired angular direction of the nozzle exit. The angular displacement between the sleeve structure sections 21 and 22 and the nozzle body 15 is determined by the circumferential spacing between the interlocking grooves and ridges of the assembly components. In a preferred embodiment, angular increments of 7.5 degrees are employed, however, smaller or larger increments may be used as desired.

FIG. 5 illustrates a modified form of the adjustable nozzle of the present invention indicated generally at 100. The nozzle assembly 100 is similar to the nozzle form of FIGS. 2 through 4 but includes centrally disposed, radially internally extending lip sections 128 that engage an annular groove 129 formed on the external surface of the nozzle body 115. Components of the assembly 100 are identified by reference numbers that are 100 higher than reference numbers employed in the identification of corresponding forms of the invention illustrated in FIGS. 2 through 4.

While preferred embodiments of the present invention has been described herein in detail, it will be appreciated that various changes in the size, shape, construction and operation of the nozzle assembly of the present invention may be made without departing from the spirit and scope of the present invention which is more fully defined by the following claims.

What is claimed is:

1. A nozzle assembly for directing the flow of fluid from a drill bit, comprising:

a sleeve structure, said sleeve structure having an external threaded area whereby said sleeve structure is adapted to be threadedly received within an internally threaded receptacle in a drill bit;

a nozzle body separably held within an internal holding surface of said sleeve structure, said nozzle body having a nozzle flow passage extending between an inlet end and an outlet end of said nozzle body whereby fluids entering said nozzle inlet end are conducted through said nozzle flow passage and exit said nozzle outlet end; and an interlocking mechanical structure disposed between said nozzle body and said sleeve structure for fixing said nozzle body and said sleeve structure at different angular positions relative to each other whereby said nozzle body may be seated and held mechanically at selected angular positions within said receptacle, said interlocking structure comprising radially inwardly protruding internal surface contours on said sleeve structure and radially inwardly depressed external surface contours on said nozzle body whereby said protruding surface contours may be received within said depressed surface contours to produce an interfering surface contact area that limits relative angular motion between said nozzle body and said sleeve structure.

2. A nozzle assembly as defined in claim 1 wherein said nozzle flow passage is configured to direct fluid from said nozzle outlet at an angle that diverges from a central cylindrical axis of said nozzle assembly.

3. A nozzle assembly as defined in claim 2, further comprising axially fixing interlocking structure between said sleeve structure and said nozzle body for preventing axial movement of said nozzle body relative to said sleeve structure when said assembly is engaged in said receptacle.

4. A nozzle assembly as defined in claim 2, further comprising:

a drive area extending axially away from said outlet end of said nozzle body for the application of rotary torque to said nozzle assembly, said drive area being centrally disposed about a central axis of said assembly and in surrounding relationship with said nozzle flow passage; and circumferentially disposed external wrench surfaces formed on said drive area adapted to receive a surrounding drive tool whereby torque forces applied to said wrench produce substantially compressive forces in said drive area.

5. A nozzle assembly as defined in claim 2 wherein said sleeve structure is constructed of steel and said nozzle body is constructed of tungsten carbide.

6. A nozzle assembly as defined in claim 2 wherein said sleeve structure comprises a two-piece sleeve section having the internal surface contours that can be mated with the external surface contours of said nozzle body at multiple relative angular dispositions of the sleeve structure and the nozzle body.

7. A nozzle assembly as defined in claim 6 wherein said contours comprise multiple, axially extending, adjacent ridge and groove formations.

8. A nozzle assembly as defined in claim 1, further comprising axially fixing interlocking structure between said sleeve structure and said nozzle body for preventing axial movement of said nozzle body relative to said sleeve structure when said assembly is engaged in said receptacle.

9. A nozzle assembly as defined in claim 1, further comprising:

a drive area extending axially away from said outlet end of said nozzle body for the application of rotary torque to said nozzle assembly, said drive area being centrally disposed about a central axis of said assembly and in surrounding relationship with said nozzle flow passage; and circumferentially disposed external wrench surfaces formed on said drive area adapted to receive a surrounding drive tool whereby torque forces applied to said wrench produce substantially compressive forces in said drive area.

10. A nozzle assembly as defined in claim 1 wherein said sleeve structure is constructed of steel and said nozzle body is constructed of tungsten carbide.

11. A nozzle assembly as defined in claim 1 wherein said interlocking mechanical structure comprises a plurality of axially extending planar surfaces formed on said nozzle body and said sleeve structure.

12. A nozzle assembly as defined in claim 1, wherein said sleeve structure comprises a two-piece sleeve section having the internal surface contours that can be mated with the external surface contours of said nozzle body at multiple relative angular dispositions of the sleeve structure and the nozzle body.

13. A nozzle assembly as defined in claim 12 wherein said contours comprise multiple, axially extending, adjacent ridge and groove formations.

14. A nozzle assembly for directing and controlling the flow of drilling fluids exiting from a drill bit, comprising:

an axially extending nozzle body having a fluid inlet at one axial end of said nozzle body and a fluid outlet at an opposite axial end of said nozzle body;

an external nozzle body surface extending axially between said fluid inlet end and said fluid outlet end;

a fluid flow passage extending axially through said nozzle body between said inlet end and said outlet end;

an axially extending sleeve structure disposed at least partially about said nozzle body in physical contact with at least a portion of said external nozzle body surface; and a mechanically interlocking structure between said sleeve structure and said nozzle body for annularly and axially fixing said nozzle body and said sleeve structure relative to each other at selected angular positions, said interlocking structure comprising circumferentially spaced surfaces extending radially from said sleeve structure and from said nozzle body.

15. A nozzle assembly for directing the flow of fluid from a drill bit, comprising:

a sleeve structure, said sleeve structure having an external threaded area whereby said sleeve structure is adapted to be threadedly received within an internally threaded receptacle in a drill bit;

a nozzle body separably held within an internal holding surface of said sleeve structure, said nozzle body having a nozzle flow passage extending between an inlet end and an outlet end of said nozzle body whereby fluids entering said nozzle inlet end are conducted through said nozzle flow passage and exit said nozzle outlet end;

an interlocking mechanical structure disposed between said nozzle body and said sleeve structure for fixing said nozzle body and said sleeve structure at different angular positions relative to each other whereby said nozzle body may be seated and held mechanically at selected angular positions within said receptacle, and wherein said interlocking mechanical structure disposed between said nozzle body and said sleeve structure comprises radially inwardly protruding internal surface contours on said internal holding surface of said sleeve structure that are received within radially inwardly recessed external surface contours on said nozzle body.

16. A nozzle assembly for directing the flow of fluid from a drill bit, comprising:

a sleeve structure, said sleeve structure having an external threaded area whereby said sleeve structure is adapted to be threadedly received within an internally threaded receptacle in a drill bit;

a nozzle body separably held within an internal holding surface of said sleeve structure, said nozzle body having a nozzle flow passage extending between an inlet end and an outlet end of said nozzle body whereby fluids entering said nozzle inlet end are conducted through said nozzle flow passage and exit said nozzle outlet end;

an interlocking mechanical structure disposed between said nozzle body and said sleeve structure for fixing said nozzle body and said sleeve structure at different angular positions relative to each other whereby said nozzle body may be seated and held mechanically at selected angular positions within said receptacle;

a drive area extending axially away from said outlet end of said nozzle body for the application of rotary torque to said nozzle assembly, said drive area being centrally disposed about a central axis of said assembly and in surrounding relationship with said nozzle flow passage; and circumferentially disposed external wrench surfaces formed on said drive area adapted to receive a surrounding drive tool whereby torque forces applied to said wrench produce substantially compressive forces in said drive area.

17. A nozzle assembly for directing the flow of fluid from a drill bit, comprising:

a sleeve structure, said sleeve structure having an external threaded area whereby said sleeve structure is adapted to be threadedly received within an internally threaded receptacle in a drill bit;

a nozzle body separably held within an internal holding surface of said sleeve structure, said nozzle body having a nozzle flow passage extending between an inlet end and an outlet end of said nozzle body whereby fluids entering said nozzle inlet end are conducted through said nozzle flow passage and exit said nozzle outlet end; and an interlocking mechanical structure disposed between said nozzle body and said sleeve structure for fixing said nozzle body and said sleeve structure at different angular positions relative to each other whereby said nozzle body may be seated and held mechanically at selected angular positions within said receptacle, and wherein said sleeve structure comprises a two-piece sleeve section having an internal surface contour that can be mated with the external surface contours of said nozzle body at multiple relative angular dispositions of the sleeve structure and the nozzle body.

18. A nozzle assembly as defined in claim 17 wherein said contours comprise multiple, axially extending, adjacent ridge and groove formations.

19. A nozzle assembly for directing the flow of fluid from a drill bit, comprising:

a sleeve structure, said sleeve structure having an external threaded area whereby said sleeve structure is adapted to be threadedly received within an internally threaded receptacle in a drill bit;

a nozzle body separably held within an internal holding surface of said sleeve structure, said nozzle body having a nozzle flow passage extending between an inlet end and an outlet end of said nozzle body whereby fluids entering said nozzle inlet end are conducted through said nozzle flow passage and exit said nozzle outlet end;

an interlocking mechanical structure disposed between said nozzle body and said sleeve structure for fixing said nozzle body and said sleeve structure at different angular positions relative to each other whereby said nozzle body may be seated and held mechanically at selected angular positions within said receptacle, and wherein said nozzle flow passage is configured to direct fluid from said nozzle outlet at an angle that diverges from a central cylindrical axis of said nozzle assembly; and wherein said interlocking mechanical structure disposed between said nozzle body and said sleeve structure comprises radially inwardly protruding internal surface contours on said internal holding surface of said sleeve structure that are received within radially inwardly recessed external surface contours on said nozzle body.

20. A nozzle assembly for directing the flow of fluid from a drill bit, comprising:

a sleeve structure, said sleeve structure having an external threaded area whereby said sleeve structure is adapted to be threadedly received within an internally threaded receptacle in a drill bit;

a nozzle body separably held within an internal holding surface of said sleeve structure, said nozzle body having a nozzle flow passage extending between an inlet end and an outlet end of said nozzle body whereby fluids entering said nozzle inlet end are conducted through said nozzle flow passage and exit said nozzle outlet end;

an interlocking mechanical structure disposed between said nozzle body and said sleeve structure for fixing said nozzle body and said sleeve structure at different angular positions relative to each other whereby said nozzle body may be seated and held mechanically at selected angular positions within said receptacle, and wherein said nozzle flow passage is configured to direct fluid from said nozzle outlet at an angle that diverges from a central cylindrical axis of said nozzle assembly;

a drive area extending axially away from said outlet end of said nozzle body for the application of rotary torque to said nozzle assembly, said drive area being centrally disposed about a central axis of said assembly and in surrounding relationship with said nozzle flow passage; and circumferentially disposed external wrench surfaces formed on said drive area adapted to receive a surrounding drive tool whereby torque forces applied to said wrench produce substantially compressive forces in said drive area.

21. A nozzle assembly for directing the flow of fluid from a drill bit, comprising:

a sleeve structure, said sleeve structure having an external threaded area whereby said sleeve structure is adapted to be threadedly received within an internally threaded receptacle in a drill bit;

a nozzle body separably held within an internal holding surface of said sleeve structure, said nozzle body having a nozzle flow passage extending between an inlet end and an outlet end of said nozzle body whereby fluids entering said nozzle inlet end are conducted through said nozzle flow passage and exit said nozzle outlet end; and an interlocking mechanical structure disposed between said nozzle body and said sleeve structure for fixing said nozzle body and said sleeve structure at different angular positions relative to each other whereby said nozzle body may be seated and held mechanically at selected angular positions within said receptacle, and wherein said nozzle flow passage is configured to direct fluid from said nozzle outlet at an angle that diverges from a central cylindrical axis of said nozzle assembly, and wherein said sleeve structure comprises a two-piece sleeve section having an internal surface contour that can be mated with the external surface contours of said nozzle body at multiple relative angular disposition of the sleeve structure and the nozzle body.

22. A nozzle assembly as defined in claim 21 wherein said contours comprise multiple, axially extending, adjacent ridge and groove formations.

* * * * *

UNITED STATES PATENT AND TRADEMARK OFFICE
Certificate

Patent No. 5,967,244 Patented: October 19, 1999

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert W. Arfele, Houston, TX; and Harry E. Nover, Woodland.

Signed and Sealed this First Day of July 2003.

DAVID J. BAGNELL
*Supervisory Patent Examiner*
Art Unit 3672

UNITED STATES PATENT AND TRADEMARK OFFICE
Certificate

Patent No. 5,967,244 Patented: October 19, 1999

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert W. Arfele, Houston, TX; and Harry E. Nover, The Woodlands, TX.

Signed and Sealed this Fourth Day of May 2004.

DAVID J. BAGNELL
*Supervisory Patent Examiner*
Art Unit 3672